United States Patent [19]

Freisinger et al.

[11] Patent Number: 4,986,562

[45] Date of Patent: Jan. 22, 1991

[54] SKI BINDING

[75] Inventors: Henry Freisinger, Vienna; Hubert Würther, Hainburg/Donau; Karl Stritzl; Egon Brunhuber, both of Vienna, all of Austria

[73] Assignee: TMC Corporation, Barr/Zug, Switzerland

[21] Appl. No.: 362,181

[22] Filed: Jun. 6, 1989

[30] Foreign Application Priority Data

Jun. 9, 1988 [AT] Austria ..... 1503/88

[51] Int. Cl.[5] ..... A63C 9/00

[52] U.S. Cl. ..... 280/633; 280/618

[58] Field of Search ..... 280/633, 634, 618, 636

[56] References Cited

U.S. PATENT DOCUMENTS

| | | | |
|---|---|---|---|
| 4,185,852 | 1/1980 | Himmetsberger | 280/618 |
| 4,600,213 | 7/1986 | Sedlmair et al. | 280/618 |
| 4,699,398 | 10/1987 | Luschnig et al. | 280/633 |
| 4,861,064 | 8/1889 | Stritzl et al. | 280/618 |

FOREIGN PATENT DOCUMENTS

| | | | |
|---|---|---|---|
| 386537 | 9/1988 | Austria . | |
| 3122468 | 4/1982 | Fed. Rep. of Germany | 280/633 |

*Primary Examiner*—David M. Mitchell

*Attorney, Agent, or Firm*—Finnegan, Henderson, Farabow, Garrett & Dunner

[57] ABSTRACT

This ski binding has a guide plate which is pivotable about a pivot pin fixed to the ski and on which a sled carrying a toe unit is displaceably guided and on which a heel unit is located. The guide plate is provided with a recess which extends in the longitudinal direction thereof and the longitudinal sides of which carry rows of teeth in which the teeth of a locking member engage.

In order to accomplish an automatic compensation of the length tolerances of the ski boot in this ski binding, the invention provides that the sled (11) has a recess (11*c*) and a downward-pointing rectangular angle piece (11*a*) on which one end of at least one compression spring (18) is supported, and that the other end of the compression spring (18) bears against the locking member designed as an insertion piece (16).

8 Claims, 3 Drawing Sheets

SKI BINDING

BACKGROUND OF THE INVENTION

1. Field of the Invention

The invention relates to a ski binding wherein the distance between the sole unit and the heel unit is adjustable.

2. Description of the Related Art

A ski binding of this type is described in Austrian Patent No. 386,537 published before the filing date of this application. This ski binding has the disadvantage that the toe unit is removably secured relative to the heel unit by means of a locking system. However, during assembly of the ski binding, deviations from the nominal value sometimes occur, for example if, during adjustment, the teeth of the locking member and the rack are in a position with the teeth against each other. These deviations make proper clamping of the ski boot questionable. Moreover, temperature fluctuations cause changes in the length of the ski boot, which can lead to jamming of the ski boot in the binding under some circumstances.

It is the object of the invention to eliminate the above disadvantages and to provide a ski binding in which an automatic fine readjustment of the toe unit relative to the heel unit is carried out. The objects of the invention are achieved by providing a ski binding wherein connection between the toe unit and the guide plate is no longer rigid, but minor displacement of the sled relative to the guide plate is possible.

The idea of providing a plate which is pivotable about a pivot fixed to the ski and carrying only a heel unit with two compression springs is already known per se, as shown by Swiss Patent No. 642,555. However, the object of these compression springs is to return the plate to its original position after a twisting fall.

A similar design is shown by Swiss Patent No. 636,274. In this design, the plate, which is pivotable about a pivot fixed to the ski, consists of two parts. The front part, which, in the running position, is secured by a release pin, is connected to the rear part of the plate by means of a slider which is subject to the action of two compression springs. In the event of a twisting fall, the front part of the plate is released from the release pin, and the plate can swivel out to the side. The front part is thereby pushed away from the rear part by the compression springs, releasing the ski boot.

In Austrian Patent No. 344,561, various designs of ski bindings with a sole plate are shown. In the design shown in FIGS. 1 and 2 of the Austrian patent, the toe unit is forced against the ski boot by a tensile spring, and the same applies to the design according to FIGS. 3 and 4. In the design according to FIGS. 7 to 10 of the Austrian patent, a rotatable disk is provided for a heel unit and is also mounted on the pivot in addition to the plate. Although a compression spring is accommodated in the sole plate, it merely serves to move the toe unit away from the sole holder in the event of a twisting fall.

Austrian Patent No. 355,964 describes a safety ski binding with a step-in frame which is rotatable about a spindle fixed in the ski and on which a sled carrying a toe unit and a roller is guided. The sled is subject to the action of a thrust spring so that the roller continuously bears against a control cam. As soon as the step-in frame is pivoted out during a twisting fall, the roller moves along the control cam. As a result, the toe unit is displaced towards the ski tip and releases the ski boot. This binding is unsuitable for an automatic compensation of the length tolerances of the ski boot.

SUMMARY OF THE INVENTION

According to the present invention, compression springs are provided on a U-shaped wire yoke to reliably and simply prevent buckling of the springs. The invention allows easy mounting of the wire yoke with the two compression springs and provides a pivotably mounted insertion piece.

In addition, according to the invention a cover is provided that prevents penetration of dirt into the interior of the locking device and also serves as the base for the ski boot. A slider is provided in the cover to provide access to the insertion piece.

DESCRIPTION OF THE PREFERRED EMBODIMENT

An exemplary embodiment of the invention will now be described in connection with the drawings.

Figure 1:
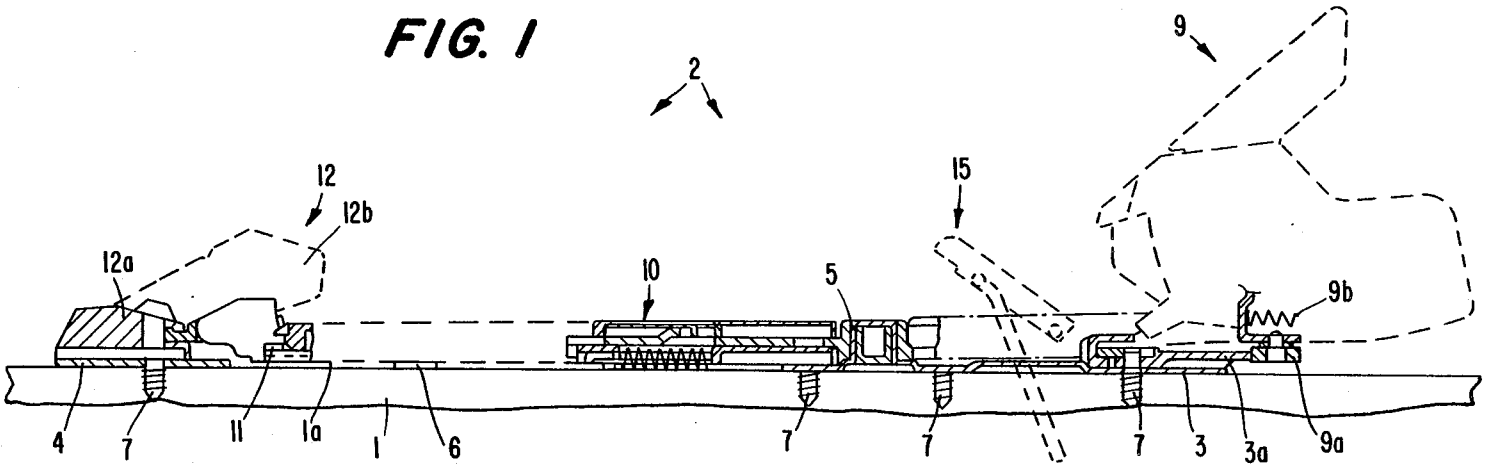
FIG. 1 is a partially cut side view of the ski binding according to the invention.
Figure 2:
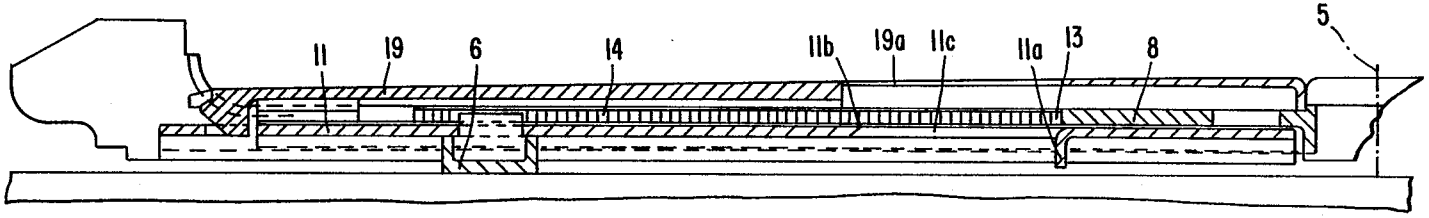
FIG. 2 shows the front region of the guide plate shown in FIG. 1, the locking device not being shown for the sake of clarity.
Figure 3:
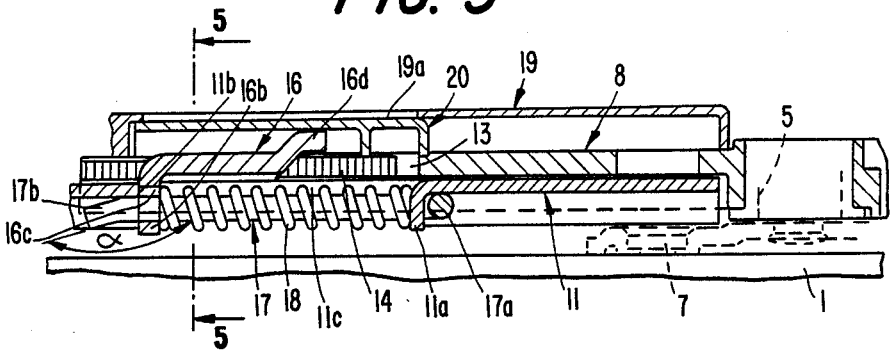
FIG. 3 shows a cross-sectional view taken along the line III—III in FIG. 6.
Figure 4:
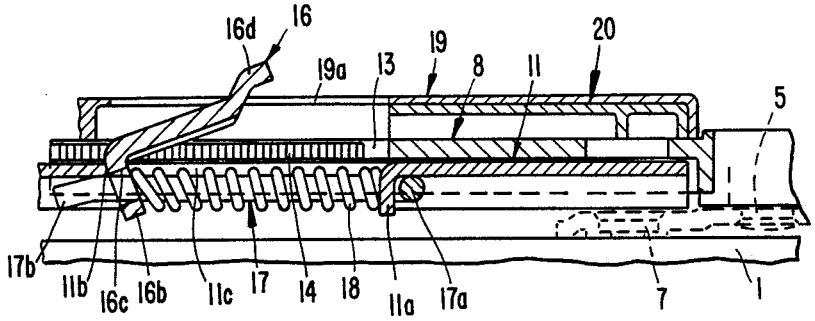
FIG. 4 shows an enlarged detail of FIG. 2.
Figure 6:
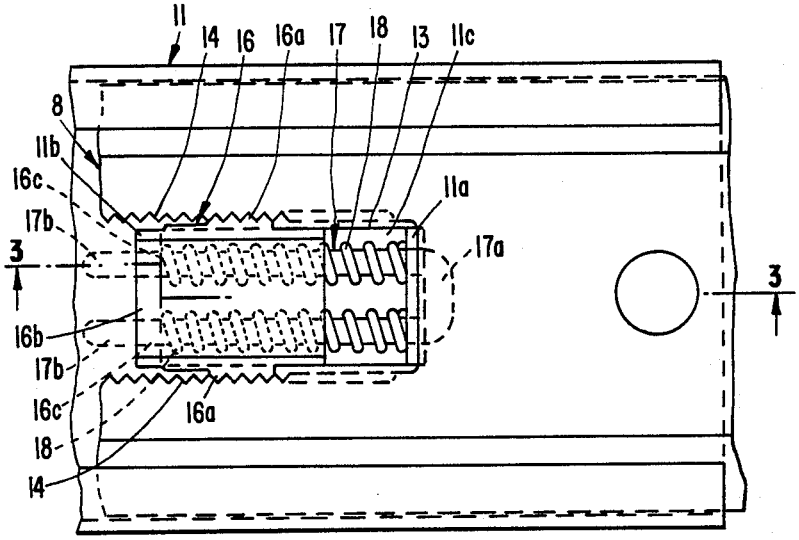
FIG. 6 is a plan view of FIG. 3, the covers being omitted.
Figure 5:
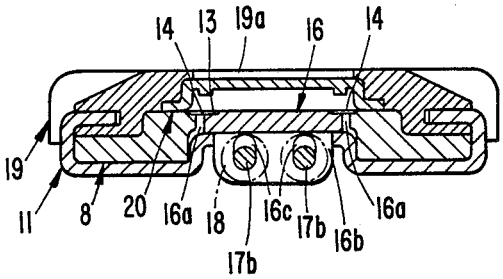
FIG. 5 is a cross-sectional view taken along the line V—V in FIG. 3.

In FIG. 1, a ski binding 2 is fixed to ski 1. This ski binding 2 has a mounting plate 3 in its rear region and a baseplate 4 in its front region. The two plates 3 and 4 are screwed to the top 1*a* of the ski 1 by means of screws 7. A pivot pin 5, which serves for pivotable mounting of a guide plate 8, is attached to the mounting plate 3. The guide plate carries at its rear end a heel unit 9, guide plate which is supported by means of a roller 9*a* under the action of two springs 9*b* on a control cam 3*a* of the mounting plate 3. The guide plate 8 and the heel unit 9 are held in their central position by means of the control cam 3*a*. A ski brake 15 of any desired type, known per se, is associated with the heel unit 9.

A sled 11, which carries the sole holder 12*b* of a two-part toe unit 12 at its front end, is guided on the front end of the guide plate 8. The front part of the toe unit 12 is designed as a guide block 12*a* for the sole holder 12*b* and is guided on the baseplate 4 for longitudinal displacement. At its front end, the sled 11 carries a slidinq plate 6 on its underside.

The design of the toe unit 12, of the heel unit 9 and of the ski brake 15 is not per se the subject of the invention. For this reason, the particular constructional design of these parts of the binding are not discussed.

A locking device 10 relating to the essence of the invention is described in more detail below. The guide plate 8 has a recess 13, the longitudinal sides of which carry rows of teeth 14. The sled 11 carries a downward-pointing angle piece 11*a* in the half next to the pivot pin 5. An insertion piece 16, which, in the locked position, engages with its teeth 16*a* in the rows of teeth 14 of the guide plate 8, is inserted into the region of the recess 13 remote from the pivot pin 5. The insertion piece 16 is provided with an angle bend 16b which is supported on one end face 11b of a recess 11c in the sled 11. In this way, the insertion piece 16 can be pivoted, its teeth 16a leaving the row of teeth 14 of the guide plate 8. In addition, the insertion piece 16 is provided with an upward bend 16d which allows a screwdriver to be applied during the adjustment step.

On the underside of the sled 11, a U-shaped wire yoke 17 is located, the link 17a of which bears against the angle piece 11a. The two arms 17b of the wire yoke 17 are mounted in slots 16c which are recessed in the angle bend 16b of the insertion piece 16. The free ends of the arms of the wire yoke 17 are angled off by an obtuse angle $\alpha$, so that they can be introduced on assembly. On the two arms 17b of the wire yoke 17, between the angle piece 11a of the sled 11 and the angle bend 16b of the insertion piece 16, compression springs 18 are provided which tend to displace the sled 11 over the insertion piece 16 and hence over the guide plate 8 towards the pivot pin 5. These compression springs 18 have the purpose of compensating, on the one hand, inaccuracies on assembly, and, on the other hand, length changes due to temperature fluctuations, during which the length of the clamped-in ski boot changes. This measure is thus intended to effect an automatic fine readjustment of the toe unit.

The sled 11 is provided with a cover 19 of U-shaped cross-section, which covers the locking device 10 from above. In its middle region, this cover 19 is located at a distance from the guide plate 8 and has a bore 19a above the locking device 10. Below this bore 19a, a slider 20 is located which covers the insertion piece 16 and the two rows of teeth 14 and thus secures the insertion piece 16 in its locked position. The cover 19 and the slider 20 are advantageously made of plastic.

In the running position, the ski binding 2 is in the position shown in FIG. 1. In order to adjust the position of the toe unit 12 relative to the pivot pin 5 fixed to the ski, the slider 20 is shifted by the user with a finger in the direction of the pivot pin 5. The insertion piece 16 is then pivoted counterclockwise to disengage teeth 16a from the two rows of teeth 14. In this position of the insertion teeth 16, the sled 11 can be adjusted in both directions relative to the guide plate 8.

When the desired position of the sled 11 has been reached, the insertion piece 16, which is subject to the action of the compression springs 18, is released, whereupon it pivots clockwise. Its teeth 16a thus come into engagement with the two rows of teeth 14 of the guide plate 8. The slider 20 is then shifted in the direction of the toe unit 12, and ski binding 2 is then ready for a skier to step into with his ski boot.

The invention is not tied to the embodiment shown in the drawings and described above. Rather, various modifications thereof are possible without departing from the scope of the invention. For example, it would be conceivable to use tensile springs, which tend to move the insertion piece into the locked position, in place of compression springs. These tensile springs might, for example, be disposed between the angle piece of the sled and the pivot pin. It is also conceivable for the locking device used to be a screw drive, the screw of which meshes with a rack and has a dog on which the compression springs act.

We claim:

1. A device for the longitudinal displacement of ski binding parts on a ski, the device comprising:

a guide plate having a longitudinal recess disposed therein, said recess including teeth disposed on a side thereof, a sled mounted on said guide plate for slidable movement in the longitudinal direction of the ski, the sled having a toe unit disposed on a front end thereof and an angle piece extending in a direction toward the ski;

a pivotable insertion piece having a portion disposed to pivot into and out of said recess, said insertion piece having teeth for selective engagement with the teeth of said guide plate, said insertion piece having a transverse ling disposed at one end thereof; and a substantially U-shaped wire yoke having two arms, each arm passing through slots in the insertion piece and having a spring disposed thereon, said yoke extending between and connecting said angle piece of said sled and said transverse link of said insertion piece, said springs exerting force therebetween.

2. A device according to claim 1, wherein said arms of said yoke extend through said angle piece.

3. A device according to claim 1, further including a cover disposed on the guide plate, the cover including an opening disposed above said insertion piece and a slider disposed in said opening for movement between a first position covering said insertion piece and a second position exposing said insertion piece.

4. A device according to claim 3, wherein said slider in said first position covers said insertion piece to prevent said insertion piece from being pivoted out of said recess.

5. A device according to claim 1, wherein an end of said insertion piece opposite said transverse link includes an upwardly bent portion.

6. A device according to claim 1 further including a pivot pin, said guide plate being pivotable in a plane parallel to a top surface of the ski about said pivot pin.

7. The ski binding as claimed in claim 1, wherein the ends of the arms of the yoke extend in a direction toward the ski at an obtuse angle.

8. The ski binding as claimed in any of claims 1 or 7, wherein the insertion piece includes an angle bend which is supported on an edge of said recess in the sled.

* * * * *